United States Patent [19]

Fletcher

[11] 3,959,995

[45] June 1, 1976

[54] SKI LOCK

[76] Inventor: Gerald William Fletcher, 568 Valley View Way, Ventura, Calif. 93003

[22] Filed: June 9, 1975

[21] Appl. No.: 585,184

[52] U.S. Cl. ..... 70/18; 70/58

[51] Int. Cl.[2] ..... E05B 73/00

[58] Field of Search ..... 70/14, 15, 18, 57, 58, 70/226–227, 233; 280/11.37 C, 11.37 K, 11.37 A; 211/60 SK; 224/45 S, 5 Z

[56] References Cited

UNITED STATES PATENTS

| | | | |
|---|---|---|---|
| 2,133,883 | 10/1938 | Aubert | 280/11.37 |
| 3,643,810 | 2/1972 | Highberger | 211/60 SK |
| 3,754,420 | 8/1973 | Oellerich | 70/58 |

FOREIGN PATENTS OR APPLICATIONS

| | | | |
|---|---|---|---|
| 1,806,014 | 5/1970 | Germany | 70/58 |

*Primary Examiner*—Robert L. Wolfe

[57] ABSTRACT

Hinged plates are formed into a rectangular structure to surround a pair of skis in bottom-to-bottom relationship between the bindings. The end plates are locked together by a padlock together with a chain surrounding a permanent fixture so that the skis cannot be stolen. The rectangle plate configuration about the skis is such that it cannot be slipped off the ends of the skis because of the interference with the bindings.

2 Claims, 6 Drawing Figures

SKI LOCK

This invention relates to locking devices and more particularly to a specially designed lock for skis.

BACKGROUND OF THE INVENTION

Between ski runs at various resorts, it is not uncommon for a skier to remove his skis at certain times during the day so that he can have refreshments or simply relax. Oftentimes, skiers will simply rest their skis against the side of a ski lodge or other area during such other activities. In other instances, ski racks are provided for use by skiers to store the skis temporarily.

In all such situations, it is not al all unusual for one skier to inadvertently take another skier's skis, mistaking them for his own. More serious, however, is the general theft of skis that often takes place in ski areas.

As a consequence of the foregoing, skiers will usually lock their skis to some permanent fixture in or near the ski lodge such as a post or the like. Normally, some type of strap or chain is encircled about the skis to hold them to the post and a padlock or combination lock used to secure the same. The problem with attempting to lock the skis in this manner is that they can be slipped out of the surrounding chain or strap by working the chain over one end of the skis. Since a chain or strap must necessarily be flexible in order to surround the skis and enable securing of them to a permanent fixture, it is almost impossible to prevent the working loose of the skis from this type of locking arrangement.

Proposals have been made to overcome the foregoing problem, such as the provision of bars which can be secured about the skis in such a manner that they cannot be worked off. The bars in turn can be then secured to a permanent fixture by a chain and padlock. The problem with such proposals is that the bars or rigid members employed are heavy and bulky and cannot be conveniently carried by the skier and thus in order to lock his skis, he must first run the risk of leaving them to obtain the bulky bar locking structure and then return and affix the same to the skis.

BRIEF DESCRIPTION OF THE PRESENT INVENTION

Bearing the foregoing in mind, the present invention contemplates an improved ski lock which overcomes various problems associated with prior art ski locks.

More particularly, the ski lock of the present invention comprises a rectangular structure made up of rigid elongated plates, at least one plate being movable to open the rectangle and permit the same to be positioned about a pair of skis in bottom-to-bottom relationship between the toe and heel portions of the ski bindings. A lock means including a padlock and chain for example is provided to secure the one plate in closed position to complete the rectangle and further secure the rectangle to a permanent fixture so that the skis cannot be stolen.

With respect to the foregoing, the dimensioning of the short sides of the rectangle are such that the rectangle cannot be worked over the ski bindings and thus it is not possible to remove the skis without destroying them.

A further feature of the rectangular rigid plate configuration is the design of individual plates and the hinging thereof together in such a manner that the rectangle can be collapsed into a compact configuration and carried in a skier's pocket. This enormous advantage eliminates the problem of a skier having to retrieve the lock from a locker or other area. Moreover, the ski lock is always available regardless of where the skier might be.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
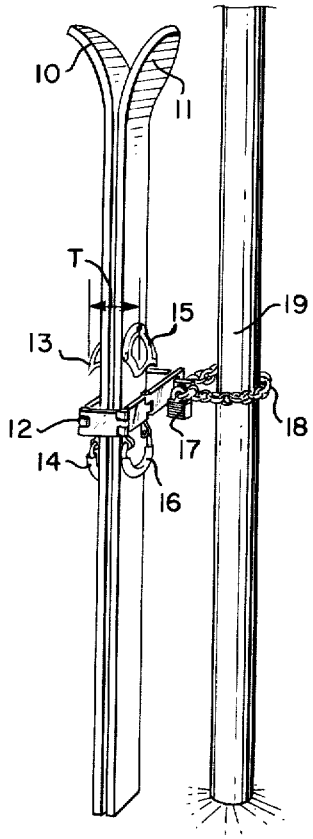
FIG. 1 is a perspective view of a pair of skis secured to a permanent fixture by the ski lock of this invention.

Referring first to FIG. 1 there is shown a pair of skis 10 and 11 in bottom-to-bottom relationship in a vertical position for being secured when temporarily not in use. The ski lock of the present invention is indicated at 12 and takes the form of a rectangular structure made up of rigid elongated plates at least one plate being movable to open the rectangle and permit the same to be positioned about the skis 10 and 11 between the toe and heel portions of the ski bindings. Thus, as shown in FIG. 1, the binding for the ski 10 includes a toe portion 13 and heel portion 14, the binding for ski 11 similarly including a toe portion 15 and heel portion 16. The dimensioning of the rectangular structure 12 is such that when it is secured about the mid portion of the skis between the bindings as shown, it cannot be moved off from the ends of the skis.

A lock means is provided in the form of a padlock 17 and chain 18 for securing the rectangle in closed position and also secure the rectangle to a permanent fixture such as a post 19.

Figure 2:
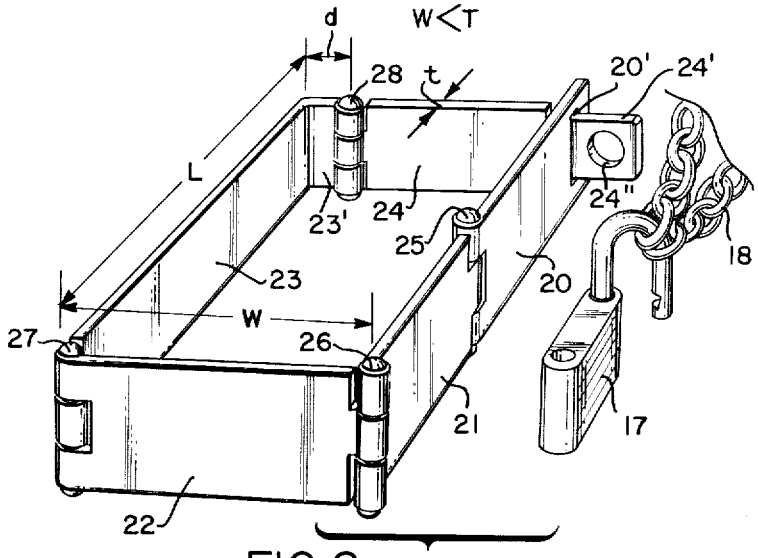
FIG. 2 is an enlarged perspective view of the ski lock itself shown in a rectangular configuration separate from the skis.

Referring to FIG. 2, details of the rectangular structure in accord with the preferred embodiment of the invention are shown. Essentially, the perimeter of the rectangle is defined by a series of elongated rigid plates 20, 21, 22, 23 and 24 hinged together as at 25, 26, 27, and 28. The longest of the rigid plates is shown at 23 and has a 90° turned end portion 23' extending for a distance $d$ equal to four times the thickness $t$ of the plates, the main portion of the plate 23 defining one long side of the rectangle. The other long side of the rectangle is in turn defined by the two plates 20 and 21 and the short sides defined by the remaining two plates 22 and 24.

As will be evident from FIG. 1, the short sides of the rectangle extend across the opposite side edges of the skis respectively while the long sides of the rectangle extend transversely across the top width of the skis between the toe and heel portions of the ski bindings as described. The short sides defined by the rigid plate 22 and the rigid plate 24 in conjunction with the turned end portion 23' have a width W less than the combined thickness of the skis and bindings, this combined thickness being indicated by the letter T in FIG. 1, so that once in place, the rectangle cannot be slid off the ends of the skis as described.

The length of the long sides of the rectangle indicated L in FIG. 2, in turn, is slightly greater than the transverse width of the skis.

In FIG. 2 it will be noted that the ends of the first and last plates 20 and 24 in the series of plates include respectively a vertical slot 20' and a narrowed extending tongue 24', the tongue being received in the slot 20' when the rigid plates are formed into the rectangle as clearly shown in FIG. 2. The narrow tongue 24' is provided with an opening 24'' through which the padlock 17 may be passed to secure the rectangle in its closed position. Also, the same padlock will secure the ends of the chain 18 after the same has been looped about the permanent fixture 19 so that the rectangular structure is secured to the permanent fixture.

Figure 4:
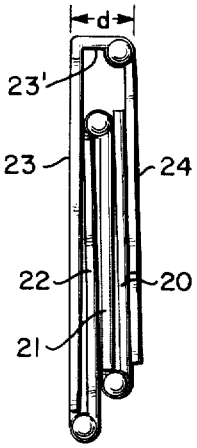
FIG. 4 is an edge view of the ski lock with the various elements in completely folded compact position for carrying by a skier.

The provision of the turned end 23' on the elongated plate 23 described in FIG. 2 together with the provision of two rigid plates 20 and 21 making up the opposite long sides of the rectangular structure enables the series of rigid plates to be folded into a compact configuration. Thus, referring to FIG. 2, it will be noted that the two plates 20 and 21 together with the short side plate 22 connecting to the end of the longest one of the plates 23 opposite its turned end can be folded in accordion style against the plate 23. The remaining plate 24 hinged to the turned end 23' can then be folded inwardly to provide the desired compact configuration. The various rigid plates when in completely folded condition are illustrated in FIG. 4. Since the distance D for the turned end portion 23' extends for approximately four times the thickness *t* of the plate, the last plate 24 will be substantially parallel to the plate 23 when in the folded position illustrated in FIG. 4, the other plates being accommodated therebetween.

The resulting contact configuration is sufficiently small that a skier can easily carry it in his pocket. On the other hand, when the same is assembled into the rectangular configuration shown in FIG. 2 and placed about the skis as described in FIG. 1 there is no possible way that a would-be thief can work the skis loose from the rectangular configuration.

Figure 3:
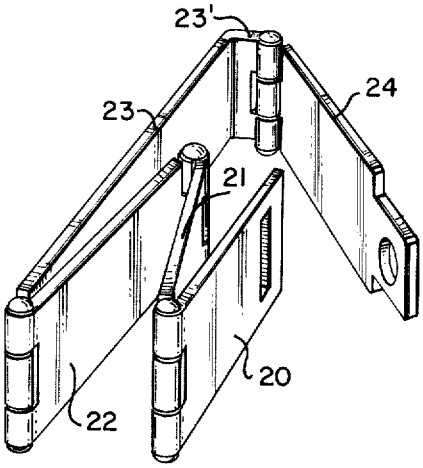
FIG. 3 is another perspective view but showing the elements of the ski lock in FIG. 2 in partially folded position.
Figure 5:
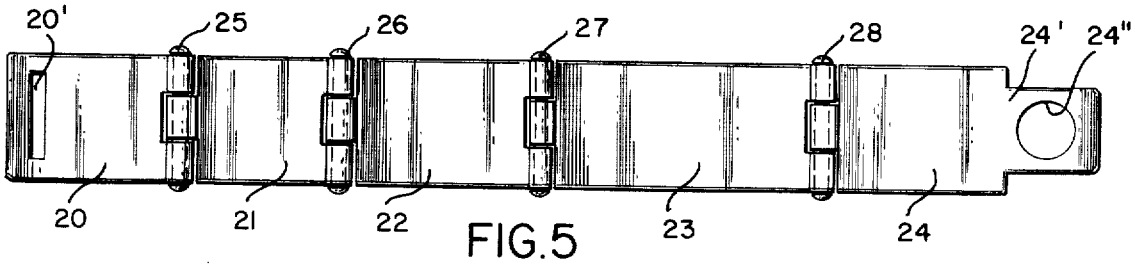
FIG. 5 is a plan view of the ski lock in completely laid out position.

FIG. 5 shows the series of plates laid out in a straight line so that the relative lengths of the same will be evident. In FIG. 5, the plates are designated by the same numerals used in FIGS. 2 and 3.

Figure 6:
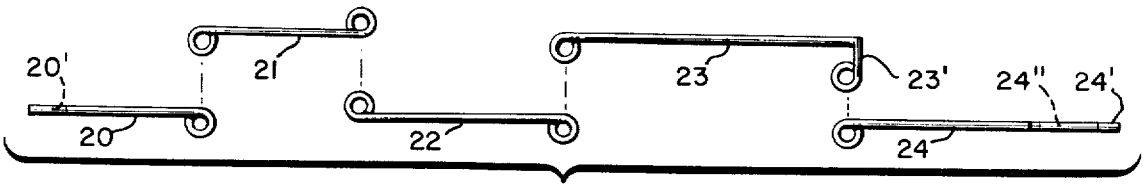
FIG. 6 is an exploded edge view of the various elements separated from each other.

FIG. 6 shows an end view of the various rigid plates separated from each other, it being understood that a hinge pin will be provided at the various hinge points 25, 26, 27, and 28, this pin being peened over on its ends to securely lock the hinge and thus secure the plates in an articulated series. Portions of the various plates in FIG. 6 are again designated by the same numerals used to identify the identical portions in FIGS. 2 and 3.

OPERATION

The operation of the ski lock of this invention will be evident from the foregoing description. Normally, a skier will simply carry the lock structure in the form of the series of articulated plates in folded configuration as shown in FIG. 4 in his pocket. He will also, of course, have a padlock and chain or equivalent means for securing the articulated plates to a permanent fixture once they have been placed about the skis.

Thus, it is very simple for the skier to simply remove the plates and unfold them to form the configuration illustrated in FIG. 2, the plates being positioned about the mid portion of the skis between the bindings as described in FIG. 1 before inserting the narrowed tongue portion 24' of the last plate 24 through the slot 20' in the end of the first plate 20.

Once the rigid plates are in position about the skis, the padlock 17 is then simply hooked through the opening 24'' and end links of the chain 18 after passing the chain about the permanent fixture 19.

When the skier again wishes to ski, he simply removes the padlock and chain and folds the rectangular configuration of rigid plates into the position illustrated in FIG. 4 for easy carrying about until it is again desired to use the lock.

From the foregoing description, it will thus be evident that the present invention has provided a greatly improved ski lock which overcomes certain disadvantages of prior art locking arrangements.

What is claimed is:

1. A ski lock comprising, in combination:

a. a series of five elongated rigid plates hinged together so that they can be formed into a perimeter defining a rectangle for placing about the central portions of a pair of skis positioned in bottom-to-bottom relationship, the longest of said plates having a ninety degree (90°) turned end portion for a distance equal to four times the thickness of the plates the main portion thereof defining one long side of said rectangle the other long side of said rectangle being defined by two of the five plates and the short sides being defined by the remaining two plates, the short sides of the rectangle extending across the opposite side edges of the skis respectively and the long sides of the rectangle extending transversely across the top width of the skis between the toe and heel portions of the ski bindings on each ski, respectively, the short sides having dimensions less than the combined thickness of the skis and bindings so that once in place, the rectangle cannot be slid off from the ends of the skis, the two plates making up said other long side together with the short side plate connecting to the end of said longest one of said plates opposite to its turned end being foldable in accordion style against said longest one of said plates, and the remaining plate hinged to the turned end portion of said longest one of said plates being foldable inwardly to provide a compact configuration which may be carried by a skier in his pocket; and b. lock means for securing together the ends of the first and last plates in the series of plates when formed into the rectangle and for securing the rectangle to a permanent fixture so that said skis cannot be stolen.

2. A ski lock according to claim 1, in which said end of the first plate in the series has a transverse slot and the said end of the last plate in the series has a narrowed tongue portion receivable through said slot when the plates are formed into said rectangle, said tongue having an opening and said lock means comprising a padlock for passing through said opening and a chain for surrounding said fixture and securement by said padlock.

* * * * *